United States Patent [19]

King

[11] Patent Number: 4,753,535

[45] Date of Patent: Jun. 28, 1988

[54] MOTIONLESS MIXER

[75] Inventor: L. Tony King, Long Beach, Calif.

[73] Assignee: Komax Systems, Inc., Long Beach, Calif.

[21] Appl. No.: 25,967

[22] Filed: Mar. 16, 1987

[51] Int. Cl.[4] ..... B01F 5/06

[52] U.S. Cl. ..... 366/337; 366/167

[58] Field of Search ..... 366/336, 337, 338, 339, 366/340, 150, 154, 167, 173, 177, 178, 76; 138/38, 42

[56] References Cited

U.S. PATENT DOCUMENTS

| | | | |
|---|---|---|---|
| 3,582,365 | 6/1971 | Lindsey | 366/340 |
| 3,749,377 | 7/1973 | Slater . | |
| 4,034,965 | 7/1977 | King | 366/336 |
| 4,054,619 | 10/1977 | Coverston . | |
| 4,114,195 | 9/1978 | Dirksing | 366/167 |
| 4,208,136 | 6/1980 | King | 366/338 |
| 4,441,823 | 4/1984 | Power | 366/340 |
| 4,564,298 | 1/1986 | Gritters | 366/167 |
| 4,616,937 | 10/1986 | King | 366/336 |

*Primary Examiner*—Robert W. Jenkins

*Attorney, Agent, or Firm*—Malcolm B. Wittenberg

[57] ABSTRACT

A device for the mixing of two fluids in a conduit which is located within the conduit substantially along its longitudinal axis. The device is shaped as an elongated body having an upstream end and a downstream end, the upstream end being characterized as having an entry port for the entry of a first fluid found in the conduit. A hollow shaft is located downstream of the entry port which contains a plurality of mixing elements. A feed port is employed for the introduction of a second fluid to be mixed with the first fluid. The feed port is positioned to feed the second fluid into the hollow shaft proximate its upstream end.

9 Claims, 2 Drawing Sheets

MOTIONLESS MIXER

TECHNICAL FIELD OF THE INVENTION

The present invention deals with a material mixing apparatus which contains various elements traditionally known as static mixers for the mixing of various components of a fluid stream. The present invention is particularly well suited for the mixing of various liquid components having widely divergent viscosities and can be employed as a pre-mixer by placing a second mixing apparatus downstream.

BACKGROUND OF THE INVENTION

It is common practice to mix particulate solids, liquids and gases with motionless mixers, having, as the name implies, no moving parts. Mixers of this category consist of baffles of various types arranged sequentially in a tube or pipe. As a process of division and recombination, separate input components can be mixed or dispersed within one another at the output of said tube or pipe. Difficulties are often experienced, however, when mixing materials of widely disparate viscosities and/or very different flow rates. For example, in the polymer field, it is at times desirable to mix very small quantities of a low-viscosity material within a much larger quantity of a high-viscosity material. When this is done, the low-viscosity material tends to tunnel through the mixing element without blending with the high viscosity material to any great extent.

It is well known that one of the mechanisms that allow for the mixing of fluids is diffusion. However, when dealing with high-viscosity materials which typically produce laminar flow, diffusion rates are very small. It is known that the rate of mass transfer (N) of the diffusing component measured in moles per second, per unit area, is equal to the diffusivity (D) multiplied by the local concentration gradient (dC/dR). Thus, since (D) is small in high-viscosity material, it is necessary to make the concentration gradient dC/dR large in order to maximize the value of the mass transfer rate.

One common industrial solution to this mixing problem is to pre-mix the additive with some of the main product before injection into the main mixer line. Although this approach is helpful, it adds considerably to the complexity of the operation.

It is thus an object of the present invention to provide a device which is capable of mixing materials having widely disparate viscosities and/or very different flow rates.

It is a further object of the present invention to provide a device which can effectively pre-mix two components of a fluid stream and feed the pre-mixture to a main mixing apparatus to improve the overall efficiency of the mixing system.

These and further objects of the present invention will be more readily appreciated when considering the following disclosure and appended claims, wherein FIG. 1 represents a schematic cross-sectional view of the device of the present invention.

SUMMARY OF THE INVENTION

The present invention deals with a device for the mixing of two fluids in a conduit which is located within the conduit substantially along its longitudinal axis. The device itself comprises an elongated body having an upstream end and a downstream end, the upstream end being characterized as having an entry port for the entry of a first fluid found in the conduit. The entry port is shaped substantially as a frustum of a cone, the upstream end of which having a relatively wide base which faces the oncoming flow of the first fluid and converging sidewalls. A hollow shaft is placed downstream of the entry port and is sized such that its diameter substantially equals the downstream diameter of the entry port. Mixing elements are placed within the hollow shaft, and a feed port for the introduction of a second fluid to be mixed with the first fluid is positioned to feed the second fluid into the hollow shaft proximate its upstream end.

As a preferred embodiment, it is contemplated that the device described above be employed as a pre-mixing element for the initial introduction of the fluids to be mixed. As such, the pre-mixture exiting this device would then be fed to a main mixing apparatus.

DETAILED DESCRIPTION OF THE INVENTION

Figure 1:
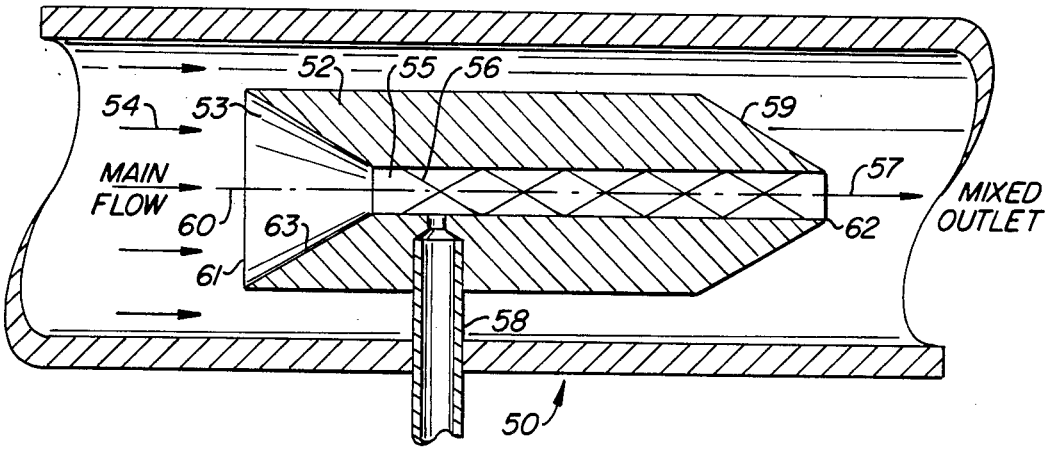

Turning first to FIG. 1, the device of the present invention is generally depicted as element 50. It is located within substantially tubular conduit 51 in which the flow of a first liquid component is shown traveling in the direction of arrows 54.

The device of the present invention, which is also generally tubular in shape, is preferably located along longitudinal axis 60 of conduit 51. The device comprises elongated body 52 having an upstream end 61 and a downstream end 62. Entry port 53 is provided for the entry of the first fluid traveling in the direction of arrows 54. The entry port is substantially shaped as the frustum of a cone, the upstream end 61 having a relatively wide base which faces the oncoming flow of the first fluid and converging sidewalls 63.

Hollow shaft 55 is provided downstream of entry port 53. The hollow shaft itself has an upstream end and downstream end whose diameter substantially equals the downstream end of entry port 53. The hollow shaft contains a plurality of mixing elements 56, the nature of which will be more fully described in reference to FIGS. 2 and 3. Ideally, elongated body 52 is provided with a taper proximate its downstream end at 59. Sloping walls are provided which define a section shaped substantially as a frustum of a cone, the upstream base of said cone being substantially equal to the area of the upstream end of the entry port and the downstream end being substantially equal to the area of the hollow shaft.

Feed port 58 is provided and has several distinct functions. Firstly, as the name implies, it is the intent to feed a second liquid to be mixed with the main liquid found within conduit 51 through feed port 58 and into the hollow shaft proximate its upstream end. It is also the function of feed port 58 to support the body 52 of the device of the present invention so that, preferably, the device's longitudinal axis will coincide with longitudinal axis 60 of conduit 51. As such, device 52 will be located substantially equidistant from the interior wall of conduit 51 throughout its entire length.

Figure 2:
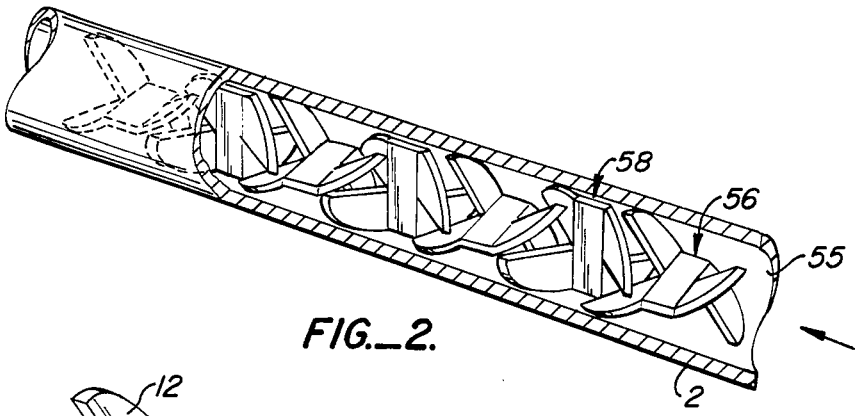
FIG. 2 represents a perspective partially cut-away view showing the nested mixing elements which are employed within the device of the present invention as a preferred embodiment.

As a preferred embodiment, it is contemplated that the interior of hollow shaft 55 contain a number of mixing elements such as those shown in Applicant's prior U.S. Pat. No. 3,923,288, issued on Dec. 2, 1975, the disclosure of which is incorporated by reference. As depicted in FIG. 2, hollow shaft 55 is shown to contain a plurality of abutting, self-nested elements. Adjacent elements are configured as mirror images of one another, each element having its length along the longitudinal axis where adjacent elements axially overlap, defining mixing matrices inducing both counter-rotational angular velocities relative to the longitudinal axis and simultaneous inward and outward radial velocities relative to the longitudinal axis on liquids moving through the mixing matrices. Each element 56 and 58 has a length along the longitudinal axis where the elements do not axially overlap, the axial non-overlapping lengths of the elements along the length of the longitudinal axis define drift spaces for the recombination of the materials subsequent to movement through the mixing matrices.

Figure 3:
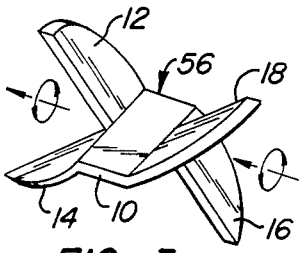
FIG. 3 depicts a single mixing element of FIG. 2.

The elements themselves can be more readily appreciated when reference is made to FIG. 3. As noted, element 56 is arbitrarily designated a left-hand element and is a mirror image of element 58 shown in FIG. 2. Element 56 includes a central flat portion 10, the plane of which is intended to be generally aligned with the longitudinal axis of chamber 55. First and second ears 12 and 14, rounded or otherwise configured at their outside peripheries for a general fit to the wall of hollow shaft 55, are bent upward and downward from the flat portion 10. A second pair of ears 16 and 18 at the opposite side of flat portion 10 are bent downward and upward, respectively. The outside peripheral edges of ears 16 and 18 are rounded or otherwise configured for a general fit to the wall of hollow shaft 55.

Figure 4:
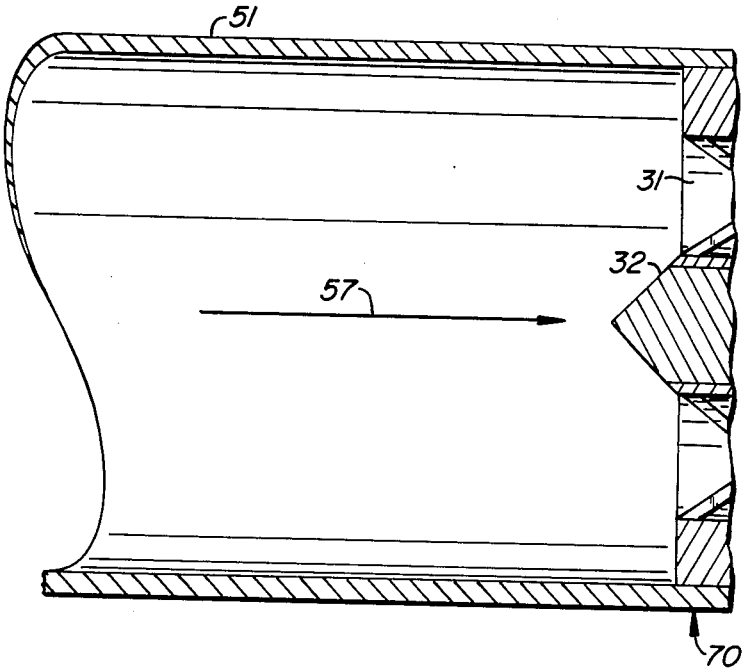
FIG. 4 depicts a sectional view of a typical main mixing apparatus which can be employed with the device shown in FIG. 1 as a preferred embodiment.

As previously noted, it is contemplated, as a preferred embodiment, to use device 50 as a pre-mixing element for a main mixing apparatus located downstream thereof within conduit 51. Such a configuration is shown in FIG. 4 where preferred main mixing apparatus 70 is shown located within conduit 51 along its longitudinal axis.

Referring again to FIG. 4, output 57, which contains a pre-mixed flow of liquids found within conduit 51 and introduced via feed port 58 is shown impacting upon main mixing apparatus 70. In its preferred embodiment, it is intended that the downstream mixing apparatus 70 be comprised of a biscuit such as that disclosed in U.S. Pat. No. 4,208,136 which issued on June 17, 1980 and is assigned to the present assignee. The disclosure found in the reference patent is incorporated here by reference.

Downstream mixing apparatus 70 generally comprises a biscuit section which possesses a plurality of openings 31 therein, and within the openings are located mixing elements such as those shown in FIG. 2 which impart a rotational velocity to the fluid as noted previously.

It is further contemplated, particularly when dealing with the mixing of fluids having widely disparate viscosities, that a conically shaped protrusion 32, whose apex is located upstream from the biscuit and approximately at the longitudinal axis of conduit 51, first intercept pre-mixed fluid stream 57. By employing this conical protrusion, one is able to increase the effective surface area of the fluid stream to enhance the diffusibility thereof and to guide the fluid within the various mixing ports 31. Such a mixing apparatus is disclosed in U.S. Pat. No. 4,616,937, which issued on Oct. 14, 1986 and which was invented by the inventor of the present invention and assigned to the same assignee.

In view of the foregoing, modifications to the disclosed embodiments can be made while remaining within the spirit of the invention. Such modifications would be obvious to one skilled in this art and, as such, the scope of the invention is to be limited only by the appended claims.

I claim:

1. A device for the mixing of two fluids in a conduit which device is located within said conduit substantially along its longitudinal axis, said device comprising an elongated body having an upstream end and a downstream end, said upstream end being characterized as having an entry port for the entry of a first fluid found in the conduit, said entry port being substantially shaped as a frustum of a cone, the upstream end of which having a relatively wide base which faces the oncoming flow of the first fluid and converging sidewalls, a hollow shaft having an upstream end and a downstream end whose diameter substantially equals the downstream end of said entry port, said hollow shaft containing a plurality of mixing elements for the mixing of said two fluids and a feed port for the introduction of a second fluid to be mixed with the first fluid, said feed port positioned to feed said second fluid into said hollow shaft proximate its upstream end.

2. The device of claim 1 wherein both said conduit and said device itself are substantially tubular in shape, each having substantially circular cross-sections whose longitudinal axes substantially overlap.

3. The device of claim 1 wherein said feed port extends substantially radially from the side wall of said conduit to support said device within said conduit.

4. The device of claim 3 wherein said feed port supports said device substantially equidistant from the interior walls of said conduit.

5. The device of claim 1 wherein said plurality of mixing elements comprise a plurality of abutting, self-nesting elements fitted within said hollow shaft, adjacent elements being configured as mirror images of one another, each element having lengths along the longitudinal axis where adjacent elements axially overlap, defining mixing matrices, inducing both counter-rotating angular velocities relative to said longitudinal axis and simultaneous inward and outward radial velocities relative to said longitudinal axis on materials moving through said mixing matrices, each element having a length along the longitudinal axis where said elements do not axially overlap, the axially non-overlapping lengths of said element along the length of the longitudinal axis defining drift spaces for the recombination of said materials subsequent to movement through the mixing matrices.

6. The device of claim 1 wherein said elongated body is tapered proximate its downstream end by providing sloping walls which define a section shaped substantially as a frustum of a cone, the upstream base of said cone being substantially equal to the area of the upstream end of the entry port and the downstream end being substantially equal to the area of the hollow shaft.

7. The device of claim 1 further comprising a second mixing apparatus located within said conduit and downstream of said device.

8. The device of claim 7 wherein said second mixing apparatus comprises a biscuit having a plurality of openings and within each opening are located mixing elements which induce a rotational angular velocity to said first and second fluids.

9. The device of claim 8 wherein said second mixing apparatus further possesses a conically-shaped protrusion whose apex is located upstream from said plurality of openings and approximately at the longitudinal axis of said conduit.

* * * * *